US009033066B2

(12) United States Patent
Gavia

(10) Patent No.: US 9,033,066 B2
(45) Date of Patent: May 19, 2015

(54) NOZZLES INCLUDING SECONDARY PASSAGES, DRILL ASSEMBLIES INCLUDING SAME AND ASSOCIATED METHODS

(75) Inventor: David Gavia, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 1072 days.

(21) Appl. No.: 12/174,340

(22) Filed: Jul. 16, 2008

(65) Prior Publication Data

US 2009/0020334 A1 Jan. 22, 2009

Related U.S. Application Data

(60) Provisional application No. 60/961,333, filed on Jul. 20, 2007.

(51) Int. Cl.
*E21B 10/61* (2006.01)
*E21B 41/00* (2006.01)

(52) U.S. Cl.
CPC ..... *E21B 41/0078* (2013.01); *E21B 10/61* (2013.01)

(58) Field of Classification Search
CPC ..... E21B 10/18; E21B 10/38; E21B 10/60; E21B 2010/607; E21B 10/61; E21B 41/0078
USPC ..... 175/57, 340, 393
See application file for complete search history.

(56) References Cited

U.S. PATENT DOCUMENTS 1,945,258 A * 1/1934 Collins ..... 175/340
2,719,027 A * 9/1955 Boice et al. ..... 175/340
3,070,182 A 12/1962 Runte
3,275,248 A * 9/1966 O'Brien et al. ..... 239/487
4,106,577 A * 8/1978 Summers ..... 175/340
4,560,860 A * 12/1985 Fauser ..... 219/470
4,570,860 A 2/1986 Aprea et al.
4,582,149 A 4/1986 Slaughter, Jr.
4,687,066 A * 8/1987 Evans ..... 175/340
4,723,612 A * 2/1988 Hicks ..... 175/393
4,784,231 A * 11/1988 Higgins ..... 175/340
4,790,394 A * 12/1988 Dickinson, III et al. ..... 175/61
4,848,476 A * 7/1989 Deane et al. ..... 175/340
5,029,656 A 7/1991 Ivie et al.

(Continued)

FOREIGN PATENT DOCUMENTS

EP 0 452 584 B1 6/1994
RU 2023859 C1 11/1994

OTHER PUBLICATIONS

Merriam-Webster's Collegiate Dictionary, 10th Ed., 1996, "radial symmetry," p. 962.

(Continued)

*Primary Examiner* — Shane Bomar
*Assistant Examiner* — Elizabeth Gitlin
(74) *Attorney, Agent, or Firm* — TraskBritt

(57) ABSTRACT

Nozzles for drilling tools, such as rotary-type drag bits and roller cone bits, a drilling tool and drilling assembly comprising nozzles, and methods of conveying drilling fluid through a nozzle for use in drilling subterranean formations are provided. A nozzle may include a substantially cylindrical nozzle body having an axis and an inlet port with a primary passage extending therethrough, and at least one secondary passage that diverges from the primary passage at an exit port.

21 Claims, 8 Drawing Sheets

(56) References Cited

U.S. PATENT DOCUMENTS

| | | | | | |
|---|---|---|---|---|---|
| 5,579,855 | A | * | 12/1996 | Dickey | 175/340 |
| 5,601,153 | A | | 2/1997 | Ensminger et al. | |
| 5,775,446 | A | | 7/1998 | Lott | |
| 5,862,871 | A | * | 1/1999 | Curlett | 175/340 |
| 5,992,763 | A | * | 11/1999 | Smith et al. | 239/428.5 |
| 6,390,212 | B1 | * | 5/2002 | Wood | 175/340 |
| 6,581,702 | B2 | * | 6/2003 | Dickey | 175/340 |
| 7,188,682 | B2 | * | 3/2007 | Larsen et al. | 175/57 |
| 7,325,632 | B2 | | 2/2008 | Larsen et al. | |
| 2001/0052556 | A1 | * | 12/2001 | Ting et al. | 239/556 |

OTHER PUBLICATIONS

Free Online Dictionary, <http://www.thefreedictionary.com/radial+symmetry> accessed May 19, 2014, 2 pages.

International Search Report for International Application No. PCT/US2008/070421 mailed Oct. 22, 2010, 5 pages.

International Written Opinion for International Application No. PCT/US2008/070421 mailed Oct. 22, 2010, 6 pages.

International Preliminary Report on Patentability for International Application No. PCT/US2008/070421 dated Oct. 26, 2010, 6 pages.

* cited by examiner

NOZZLES INCLUDING SECONDARY PASSAGES, DRILL ASSEMBLIES INCLUDING SAME AND ASSOCIATED METHODS

PRIORITY CLAIM

This application claims the benefit of the filing date of U.S. Provisional Patent Application Ser. No. 60/961,333, filed Jul. 20, 2007, for "NOZZLES INCLUDING SECONDARY PASSAGES, DRILL BIT ASSEMBLIES INCLUDING SAME AND ASSOCIATED METHODS," the disclosure of which is hereby incorporated herein in its entirety by this reference.

TECHNICAL FIELD

The invention, in various embodiments, relates to nozzles for drilling tools and assemblies for drilling subterranean formations and, more particularly, to nozzles having at least one secondary passage formed therein for divergingly directing drilling fluid spray therethrough. The invention, in certain embodiments, relates to drilling assemblies, which may include rotary-type drag bits and other certain rotary tools used for drilling subterranean formations.

BACKGROUND

Drill bits for subterranean drilling, such as drilling for hydrocarbon deposits in the form of oil and gas, conventionally include internal passages for delivering a drilling fluid, or "mud," to locations proximate a cutting structure carried by the bit. In fixed cutter drill bits, or so-called "drag" bits, the internal passages terminate proximate the bit face at locations of nozzles received in the bit body for controlling the flow of drilling mud used to cool and clean the cutting structures (conventionally polycrystalline diamond compact (PDC) or other abrasive cutting elements). Some drill bits, termed "matrix" bits, are fabricated using particulate tungsten carbide infiltrated with a molten metal alloy, commonly copper-based. Other drill bits, termed "cemented" bits, are fabricated by sintering particulate tungsten carbide and a metal or metal alloy, commonly cobalt- or nickel-based. Still other drill bits comprise steel bodies machined from blanks, billets or castings. Steel body drill bits are susceptible to erosion from high pressure, high flow rate drilling fluids, on both the face of the bit and the junk slots, as well as internally. As a consequence, on the bit face and in other high-erosion areas, hardfacing is conventionally applied. Within the bit, erosion-resistant components such as nozzles and inlet tubes fabricated from tungsten carbide or other erosion-resistant materials are employed to protect the steel of the bit body. "Matrix" bits and "cemented" bits are less susceptible to this erosion, but still require nozzles for directing desired fluid flow.

As shown in FIG. 1 of the drawings, a conventional steel body drill bit 10 for use in subterranean drilling may include a plurality of nozzle assemblies, exemplified by illustrated nozzle assembly 12. While many conventional drill bits use a single piece nozzle, the nozzle assembly 12 is a two piece replaceable nozzle assembly, the first piece being a tubular tungsten carbide inlet tube 14 that fits into a port 16 machined in the body of the drill bit 10, and is seated upon an annular shoulder 18 of port 16. The second piece is a tungsten carbide nozzle 20 that may have a restricted bore 22 that is secured within the port 16 of the drill bit 10 by threads which engage mating threads 24 on the wall of the port 16. The inlet tube 14 is retained in passage 26 by an abutment between the annular shoulder 18 and the end of the nozzle 20. Further, the outer surface or wall of the nozzle 20 is in sealing contact with a compressed O-ring 28 disposed in an annular groove formed in the wall of port 16 to provide a fluid seal between the bit body 30 and the nozzle 20.

Because of the importance of the cooling and cleaning functions of the drilling fluid, others in the field have attempted to optimize these benefits by specifically orienting the nozzle bore to direct the spray pattern of the drilling fluid to a predetermined location on a cutting surface of the bit. In still other applications designers have used computational fluid dynamics ("CFD") to model fluid as it flows across the drill bit to help determine desirable placement of the nozzles upon the bit body.

The limited ability to control drilling fluid emanating from a nozzle in a desired fashion necessarily limits the potential efficiency of the cleaning and cooling functions of the drilling fluid. Further, since conventional nozzles direct a spray pattern, in the shape of a cone, of drilling fluid along a single direction or path at a relatively high velocity, impingement of the drilling fluid emanating from a conventional nozzle upon a portion of the drill bit, i.e., a blade or other portion of the bit body, may cause excessive erosion or wear to occur. Particularly, in the case where a nozzle is designed for providing a single flow stream of drilling fluid toward multiple paths, such as toward two junk slots, excessive erosion and wear may occur on the leading end of the structure, e.g., blade, separating the single flow stream into the multiple paths.

Thus, it would be advantageous to provide a nozzle for use in subterranean earth-boring drill bits, which provides suitable cuttings removal impetus, but which reduces undesirable erosion of the drill bit within which the nozzle is installed during use. It would also be advantageous to provide a nozzle design that allows tailoring of the distribution of drilling fluid emanating from the nozzle. Additionally, it would be advantageous to provide a nozzle design that may provide a suitable main cone spray pattern, as well as a secondary spray pattern proportioned to direct the fluid flow to specific areas of the drill bit, particularly toward areas that may experience cuttings buildup, or heat, while advantageously reducing the abrasion, and wear upon the drill bit conventionally caused by direct impingement thereon by a single fluid stream.

BRIEF SUMMARY OF THE INVENTION

One embodiment of the invention comprises a nozzle for a drill bit for drilling subterranean formations. The nozzle may comprise a substantially cylindrical nozzle body having an axis, an inlet port end and an exit port end, a primary passage extending between the inlet port end and the exit port end and at least one secondary passage extending through at least a portion of the cylindrical nozzle body to the exit port end. The primary passage is substantially aligned with the axis of the cylindrical nozzle body. The at least one secondary passage diverges from the primary passage at the exit port end as it extends through the cylindrical nozzle body.

In certain other embodiments, the substantially cylindrical nozzle body comprises an exit end surface comprising the primary passage and at least one secondary passage, an outer side surface for being received into a nozzle port of a drill bit and retained therein, and an inlet end surface comprising the inlet port.

Certain embodiments further comprise a drilling tool or assembly comprising a nozzle in accordance with embodiments of the invention. The drilling tool or assembly may be a rotary-type drag bit or other tools used for drilling a subterranean formation.

In still other embodiments, a nozzle for a drilling assembly for drilling subterranean formations may comprise a substantially cylindrical nozzle body having an axis and an inlet port with a primary passage extending therethrough and substantially aligned with the axis, and at least one secondary passage extending at least partially through the cylindrical nozzle body and diverging from the primary passage.

Another embodiment of the invention comprises a method of conveying drilling fluid through a nozzle for use on a rotary drill bit or other drilling tool for forming a subterranean borehole. The method may include introducing a drilling fluid into an inlet port of a nozzle having a primary passage and at least one secondary passage, and directing the majority of the drilling fluid through the primary passage to an exit end surface of the nozzle while directing a portion of the drilling fluid through the at least one secondary passage to the exit end surface of the nozzle.

Other advantages and features of the invention will become apparent when viewed in light of the detailed description of the various embodiments of the invention when taken in conjunction with the attached drawings and appended claims.

DETAILED DESCRIPTION

Figure 1:
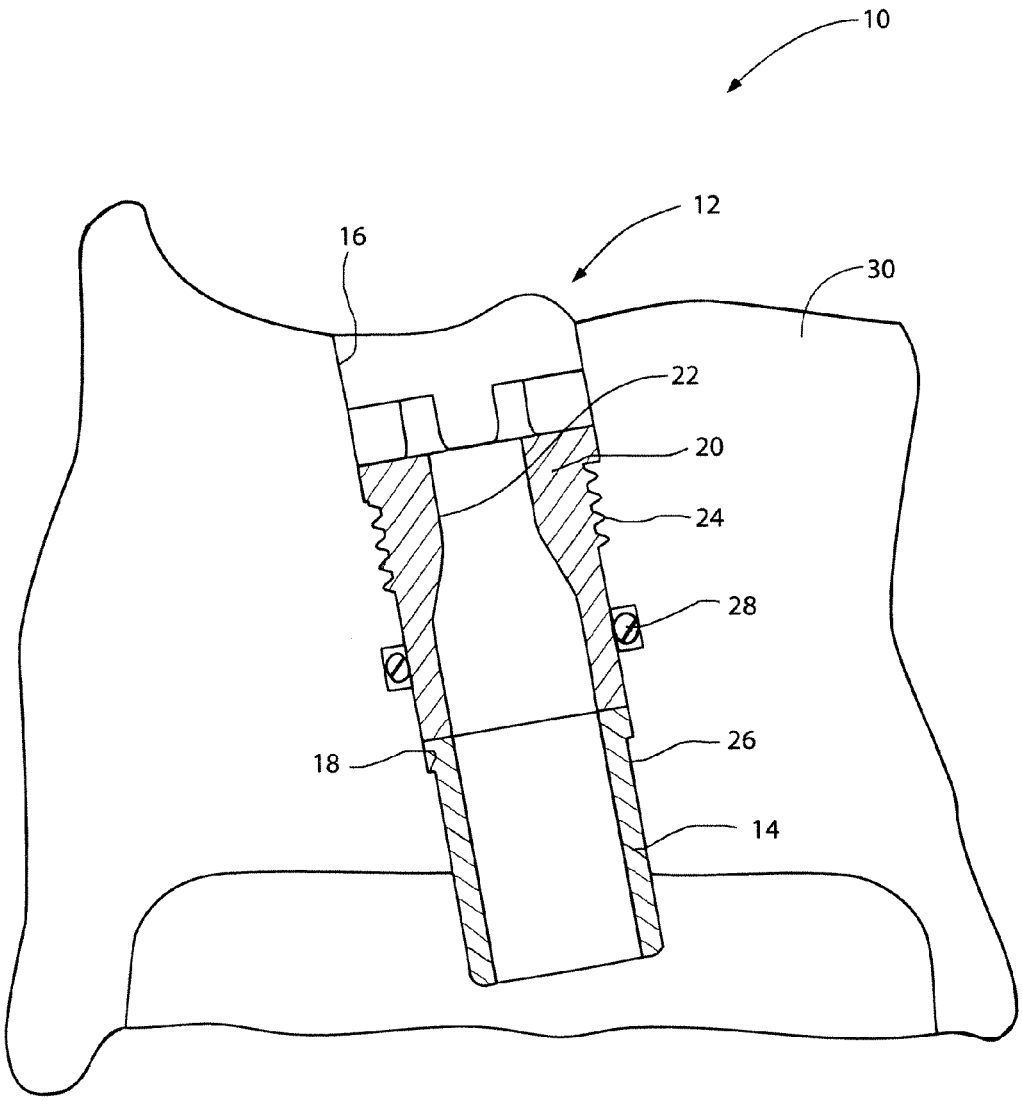
FIG. 1 (PRIOR ART)
FIG. 1 shows a partial cross-sectional view of a portion of a conventional earth-boring drill bit including a nozzle conventionally retained in a nozzle port.

In the description which follows, like elements and features among the various drawing figures are identified for convenience with the same or similar reference numerals.

Figure 2A:
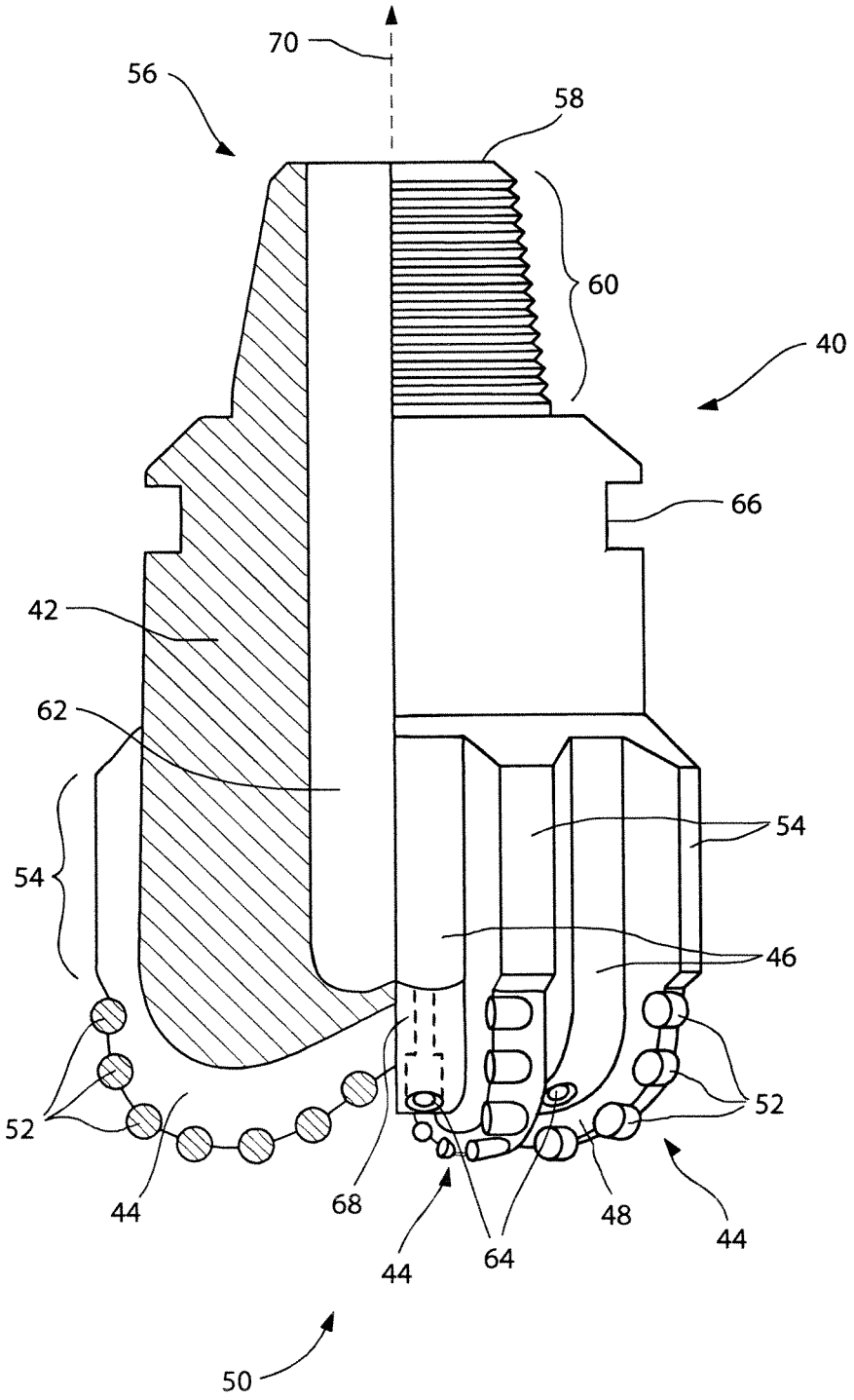
FIG. 2A shows a partial cross-sectional view of a nozzle disposed in an elongated nozzle port of a bit body of a rotary drill bit configured according to an embodiment of the invention.

Referring to FIG. 2A, a drag-type rotary drill bit 40 is shown in a partial cross-sectional view with nozzles 64 disposed in elongated nozzle ports 68 in a bit body 42 thereof. Although the invention is shown and described with respect to the rotary drill bit 40, the invention herein presented possesses equal utility and applicability in other applications, including in a so-called "tricone" or "roller cone" rotary drill bit 140 (see FIG. 2C) and other subterranean drilling tools as known in the art which employ nozzles for delivering fluids. Accordingly, as used herein, the term "rotary drill bit" includes and encompasses core bits, roller-cone bits, fixed-cutter bits, impregnated bits, eccentric bits, bicenter bits, reamers, reamer wings, or other earth-boring tools utilizing at least one nozzle for delivery of a drilling fluid as known in the art.

As shown in FIG. 2A, a rotary drill bit 40 may generally comprise a bit body 42 including a plurality of longitudinally extending blades 44 defining junk slots 46 therebetween. Each of the blades 44 may define a leading or cutting face 48 that extends radially along the bit face around the distal end 50 of the rotary drill bit 40, and may include a plurality of cutting elements 52 affixed thereto for cutting a subterranean formation upon rotation of the rotary drill bit 40. Furthermore, each of the blades 44 may include a longitudinally extending gage portion 54 that corresponds to an outermost radial surface of each of the blades 44, sized according to approximately the largest-diameter-portion of the rotary drill bit 40 and thus may be typically only slightly smaller, if at all, than the diameter of the borehole intended to be drilled by the rotary drill bit 40.

The upper longitudinal end 56 of the rotary drill bit 40, as shown in FIG. 2A, includes a threaded pin 58 including threads 60 for threaded attachment of the rotary drill bit 40 to a drill collar or downhole motor, as is known in the art. In addition, the plenum, or bore 62 longitudinally extends within the bit body 42 of the rotary drill bit 40 for communicating drilling fluid therewithin through internal passages that terminate proximate the face of the rotary drill bit 40 through nozzles 64 disposed approximate the face and recessed within the bit body 42. Nozzles 64 may comprise nozzles according to the invention, as discussed in further detail herein below. Threaded pin 58 may be machined directly into the upper longitudinal end 56 of the bit body 42 (i.e., typically a so-called "shank," as known in the art) and may include a bit breaker surface 66 for loosening and tightening the tapered threaded portion 58 of the rotary drill bit 40 when installed into a drill string (not shown).

A plurality of cutting elements 52 may be secured to the blades 44 of the rotary drill bit 40 for cutting a subterranean formation as the rotary drill bit 40 is rotated under weight on bit ("WOB") into a subterranean formation. Although FIG. 2A shows two nozzles 64, it should be understood that, more generally, at least one nozzle 64 according to the invention may be mounted within the bit body 42 of the rotary drill bit 40 for directing drilling fluid toward at least one desired location at the bottom of the subterranean borehole being cut. For instance, the at least one nozzle 64 may be threadedly secured within a nozzle port 68 formed in the bit body 42 (having complementarily formed cast or machined threads) and may include a fluid passageway therethrough (not shown) in fluid communication with the plenum 62 through which the drilling fluid is received at its inlet port and is discharged through the exit port, as described in further detail herein below. Additionally, an annular channel (not shown) in a periphery of the nozzle 64 or within the wall of nozzle port 68 may be adapted to receive or position a sealing element such as, for example, an O-ring between the nozzle port 68 and the nozzle 64 for sealing therebetween. Thus, during use, drilling fluid may be communicated through the nozzles 64 through the plenum 62 in the rotary drill bit 40.

Figure 2B:
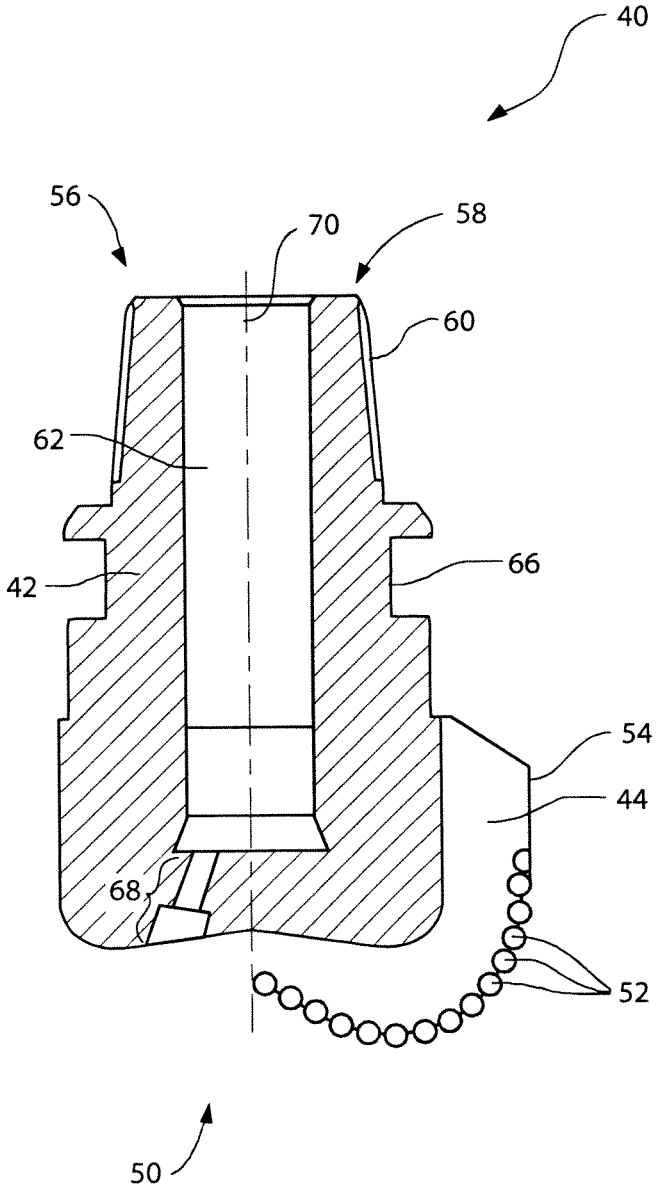
FIG. 2B shows a cross-sectional view of a rotary drag bit configured for use with certain embodiments of the invention.

For further clarity, FIG. 2B shows a side cross-sectional view of a rotary drill bit 40 taken about its longitudinal axis 70. A nozzle 64 (FIG. 2A) may be removably secured within the nozzle port 68 by a suitable mechanical affixation mechanism (e.g., threads, pins, retaining rings, etc.) as known by a person having ordinary skill in the art. For example, threaded surfaces, sleeves, or retainers may be utilized for affixing a nozzle 64 within the nozzle port 68. Alternatively, a more permanent securement of the nozzle 64 within the nozzle port 68 may be effected by way of at least one of brazing, adhesive bonding, or welding, although such techniques are generally not employed.

Generally, drilling fluid is intended for cleaning and cooling the cutting elements 52 and carries formation cuttings to the top of the borehole via the annular space between the drill string and the borehole wall. It will be understood by those persons having ordinary skill in the art that a bladed-type rotary drill bit 40 may be configured to incorporate the at least one nozzle 64 within one or more blades 44 extending from the bit body 42. In this respect, it is also understood that the nozzle 64 extends slightly above, or, more practically, must be recessed within the bit body 42 so as not to interfere with the cutting action of the cutting elements 52 or to be damaged by engagement with the subterranean formation being drilled.

Further, as mentioned above, it should be noted that the invention exhibits equal utility with all configurations of rotary drilling bits, reamers, or other subterranean drilling tools, without limitation, having blades or otherwise configured, while demonstrating particular utility with rotary drill bits wherein controlled and directed fluid flow is beneficial to the hydraulic performance thereof.

Figure 3:
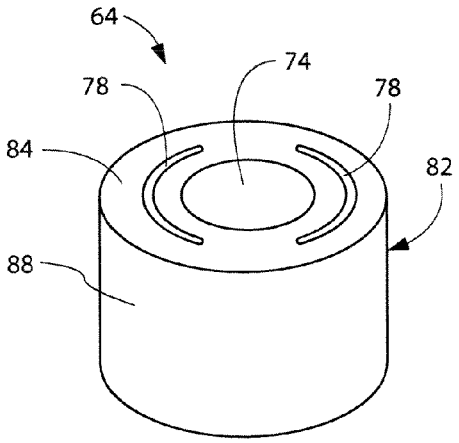
FIG. 3 shows a perspective view of a nozzle according to an embodiment of the invention.
Figure 4A:
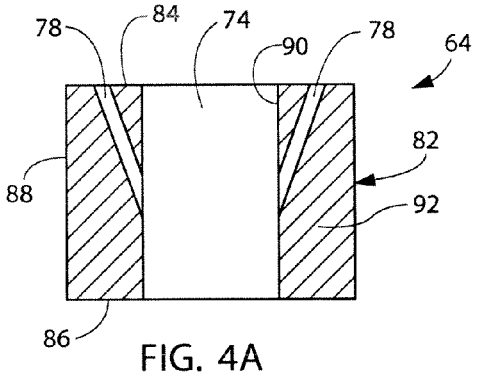
FIGS. 4A-4C show various cross-sectional views of nozzles according to embodiments of the invention.
Figure 4B:
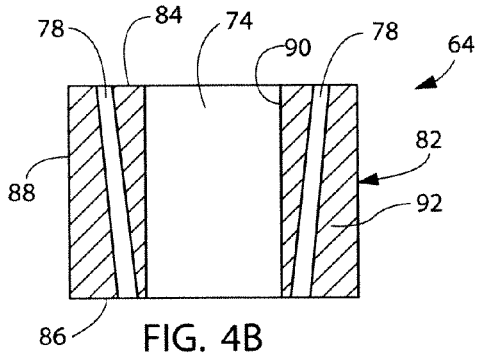
Figure 5:
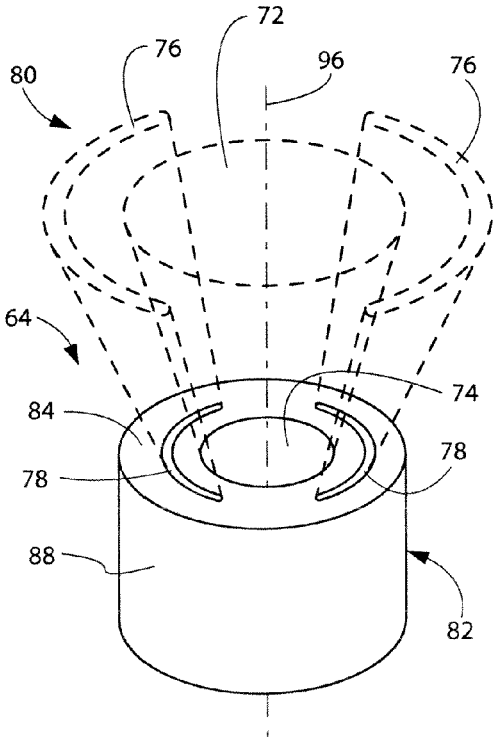
FIG. 5 illustrates a perspective view of the nozzle shown in FIGS. 3 and 4A showing projected spray patterns of drilling fluid.

Generally, as shown in FIGS. 3-5, the invention contemplates that a nozzle 64 may be configured to convey a main spray pattern 72 from a main bore, or primary passage 74, and a secondary spray pattern 76 from at least one secondary channel, or secondary passage 78. A drilling fluid is introduced into the nozzle 64 and the majority of the drilling fluid may be directed through the primary passage 74, while a portion of the drilling fluid may be directed through at least one secondary passage 78. Such a configuration may distribute (spatially) the majority of the drilling fluid passing through the primary passage 74 of the nozzle 64 in much the same manner as a conventional nozzle 20 (FIG. 1). Additionally, the nozzle 64 of the invention may simultaneously distribute a secondary spray pattern 76. The secondary spray pattern 76 may direct a spray to specific areas of the rotary drill bit 40 where cuttings buildup may occur, or an area that may experience increased friction and heat. The secondary spray pattern 76 may also increase the hydraulic footprint 80 of the nozzle 64, such that more surface areas on the bit face may benefit from a direct, tailored or proportioned spray of drilling fluid. Additionally, the primary passage 74 and the at least one secondary passage 78 may be configured to deliver a bifurcated or otherwise segmented flow of drilling fluid through the nozzle 64 such that fluid may be directed to specific areas of the rotary drill bit 40, while directing fluid away from intermediate areas of the rotary drill bit 40. This may result in reducing erosion on an intermediate portion of the bit body 42 (FIG. 2A), which may otherwise occur in response to drilling fluid impingement from a conventionally configured nozzle 20.

Figure 4C:
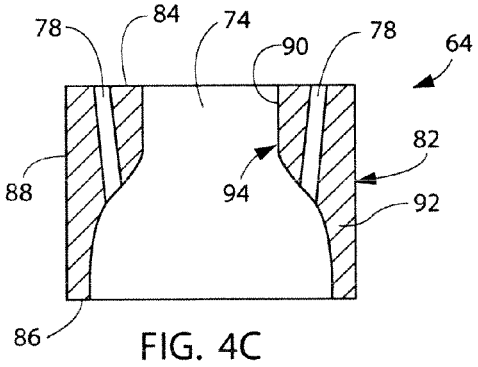

A nozzle 64 of the invention will now be described. Particularly, FIG. 3 shows a perspective view of a nozzle 64 according to the invention. As shown in FIGS. 3-4C, a nozzle 64 according to the invention may comprise a substantially cylindrical nozzle body 82 having a top or exit end surface 84, a bottom or inlet end surface 86, an outer side surface 88, and a main bore or primary passage 74. The main bore 74 may be defined by a main bore surface 90, extending from the inlet end surface 86 to the exit end surface 84. An annular nozzle wall 92 is defined by the exit end, inlet end, outer side, and main bore surfaces 84, 86, 88 and 90. As shown in FIG. 4A, at least one secondary channel, or passage 78 may be formed in the nozzle wall 92, extending to the exit end surface 84. Thus, as may be appreciated, in a drilling fluid environment, a pressure differential (i.e., higher to lower) between a fluid proximate the inlet end surface 86 and a fluid proximate the exit end surface 84 may cause fluid to flow through the main bore 74 and the one or more secondary passages 78.

The main bore 74 and the secondary passage or passages 78 may be generally configured for communicating a drilling fluid that passes through the nozzle body 82. Further, the nozzle body 82 may be configured for resisting erosion due to drilling fluid passing therethrough. For example, the nozzle wall 92 may comprise a ceramic, a cermet, or another relatively hard, erosion resistant material as known in the art. In one embodiment, the nozzle wall 92 may comprise a cobalt-cemented tungsten carbide. As an alternative to tungsten carbide, one or more of diamond, boron carbide, boron nitride, aluminum nitride, tungsten boride and carbides, nitrides and borides of Ti, Mo, Nb, V, Hf, Zr, Ta, Si, and Cr may be employed. Optionally, a material may be selected from the group of iron-based alloys, nickel, nickel-based alloys, cobalt, cobalt-based alloys, cobalt- and nickel-based alloys, aluminum-based alloys, copper-based alloys, magnesium-based alloys, and titanium-based alloys. Such a configuration may be resistant to the abrasive and erosive effects of drilling fluid during a drilling operation. In another embodiment, the nozzle wall 92 may be formed of, for example, steel lined with an abrasion and erosion-resistant material such as tungsten carbide, ceramics, or hardfacing, for example and without limitation.

The secondary passages 78 may be formed within the nozzle wall 92 in a number of configurations. For example, the secondary passages 78 may extend through the nozzle wall 92 from the main bore surface 90 to the exit end surface 84 as shown in FIG. 4A. Alternatively, the secondary passage 78 may extend from the inlet end surface 86 to the exit end surface 84 as shown in FIG. 4B. Another embodiment of a nozzle 64 may include a restricted main bore 74, wherein the secondary passages 78 may extend from the main bore surface 90 at a location below the restriction 94, as illustrated in FIG. 4C. This nozzle 64 may be, in accordance with the certain configurations herein presented, including configurations within the scope of the invention, adjusted such that the amount of fluid distributed to a secondary passage 78 may be proportioned and tailored for specific applications.

The configuration and shape of a secondary passage 78 may be advantageously adjusted to selectively affect the hydraulic footprint 80 and spray patterns 72 and 76 of the nozzle 64. The size, shape, and angle of the secondary passage 78 within the nozzle wall 92 may affect the distribution of the drilling fluid exiting the nozzle 64. For example, and as illustrated in FIG. 5, arcuate slit-shaped secondary passages 78 may extend through the nozzle wall 92 at an angle that diverges from the axis 96 of a cylindrical main bore or primary passage 74. The spray patterns 72 and 76 of the nozzle 64 may comprise a main cone spray pattern 72 directed from the primary passage 74 and secondary arcuate slit-shaped spray patterns 76 diverging from the main cone spray pattern 72. The size and shape of the main cone spray pattern 72 may be adjusted by modifying the size and shape of the primary passage 74. Likewise, the size and shape of each secondary spray pattern 76 may be adjusted by modifying the size and shape of each secondary passage 78. Additionally, the angle of divergence of the secondary passage 78 from axis 96 may be varied within the nozzle wall 92, to alter the angle that the secondary spray pattern 76 diverges from the main cone spray pattern 72. It may be understood that one may vary the size, shape and angle of the primary passage 74 and the one or more secondary passages 78 independently or cooperatively, and include one secondary passage 78 or a number of secondary passages 78 such that any desirable number of spray patterns 72 and 76 may be formed. Further examples of nozzle 64 arrangements according to the invention are described below.

Figure 6:
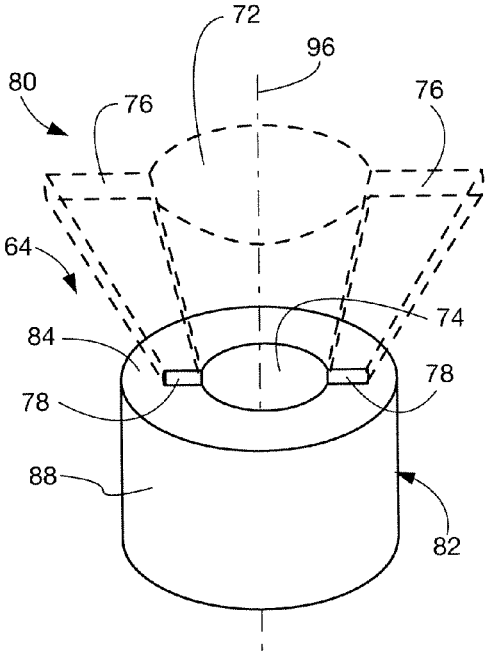
FIG. 6 illustrates a perspective view showing a projected spray pattern of a nozzle having notches according to an embodiment of the invention.
Figure 7:
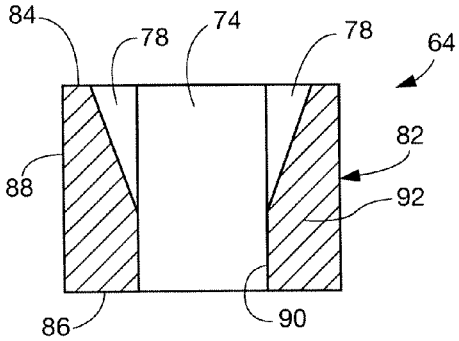
FIG. 7 shows a cross-sectional view of the nozzle shown in FIG. 6.

FIGS. 6 and 7 illustrate a nozzle 64 according to the invention including secondary passages 78 comprising notches formed through the exit end surface 84 and the main bore surface 90 of the nozzle wall 92. This configuration may result in a main cone spray pattern 72 and diverging secondary spray patterns 76, wherein there may be no flow separation between the main cone spray pattern 72 and the secondary spray patterns 76, as the primary passage 74 is in direct fluid communication with the secondary passage 78 through the nozzle wall 92. However, the secondary spray patterns 76 may diverge from the main cone spray pattern 72 such that the hydraulic footprint 80 of the nozzle 64 may be increased over that provided by a main cone spray pattern 72 in specific regions, such that specific regions outside of the main cone spray pattern 72 may have drilling fluid directed thereon.

Figure 8:
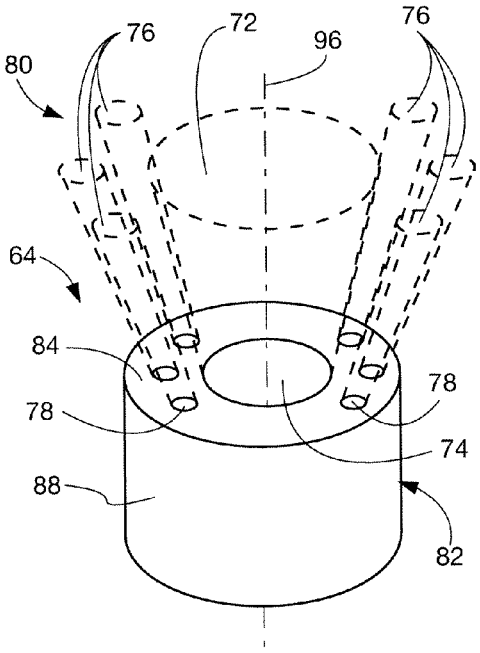
FIGS. 8 and 9 illustrate perspective views of nozzles having a plurality of secondary passages, such as bores, according to embodiments of the invention.
Figure 9:
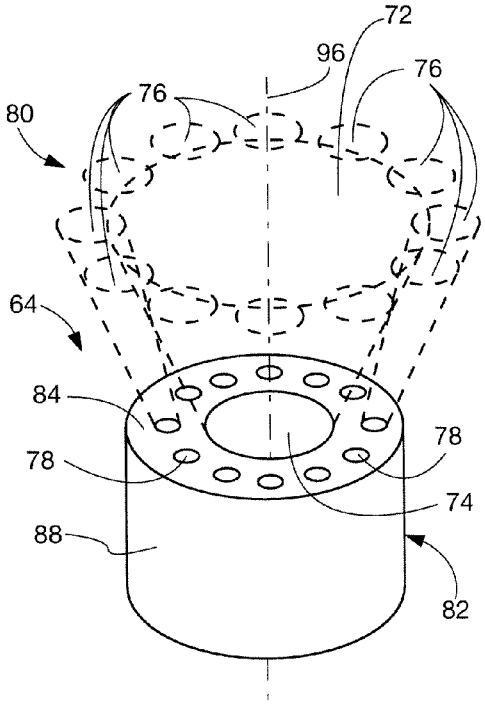

FIGS. 8 and 9 illustrate perspective views of additional nozzles 64 having a plurality of secondary passages 78, configured as discrete, circumferentially spaced bores, in additional embodiments according to the invention. The bores may be circular, conical, elliptical, or other suitable shape. The secondary passages 78 may be positioned such that the secondary cone spray pattern 76 may be oriented in specific directions, as shown in FIG. 8, or may be positioned such that the overall hydraulic footprint 80 of the nozzle 64 may be increased substantially evenly around the periphery of the main cone spray pattern 72, as shown in FIG. 9. The secondary passages 78, i.e., bores, may direct the hydraulic fluid in a plurality of secondary cone spray patterns 76, such that each secondary cone spray pattern 76 is smaller than the main cone spray pattern 72. Each secondary cone spray pattern 76 may generally diverge from the main cone spray pattern 72 as illustrated in FIG. 8. Optionally, each secondary cone spray pattern 76 may spread the fluid as it is projected away from the nozzle 64 (not shown) toward portions of each of the other secondary cone spray patterns 76, or may overlap with portions of the main cone spray pattern 72 as illustrated in FIG. 9.

Figure 2C:
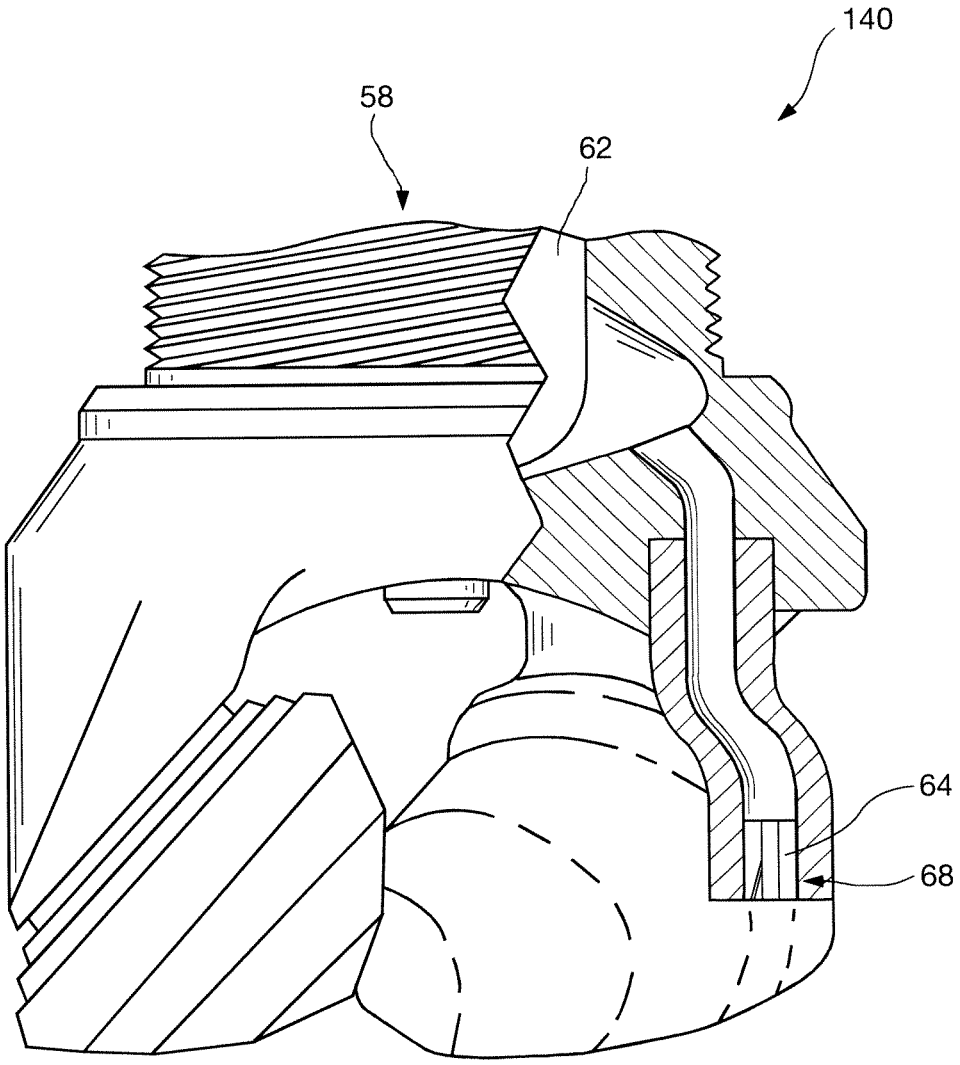
FIG. 2C shows a partial cross-sectional view of a roller cone drill bit configured with a nozzle in accordance with an embodiment of the invention.
Figure 10:
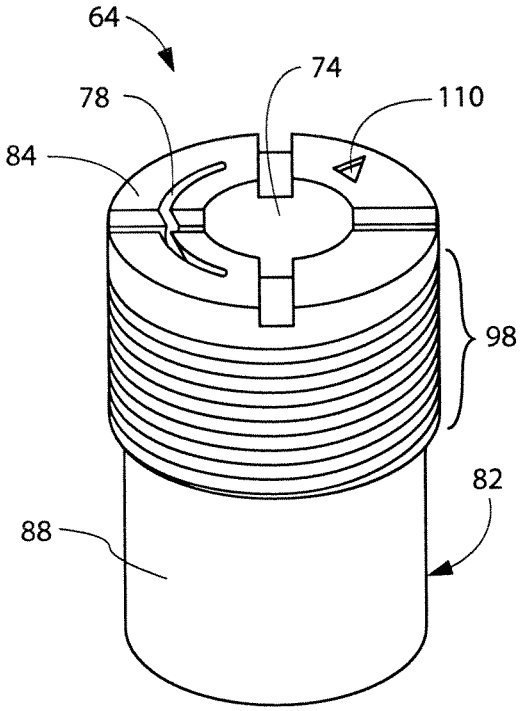
FIG. 10 shows a perspective view of a nozzle having a single secondary passage in the form of an arcuate slit and further includes a locating mark to facilitate orientation of the secondary passage according to an embodiment of the invention.
Figure 11:
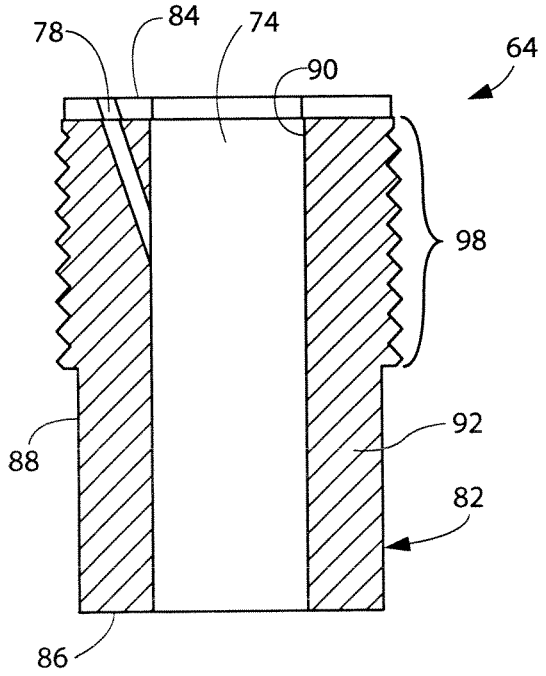
FIG. 11 shows a cross-sectional view of the nozzle shown in FIG. 10.

As shown in FIGS. 10 and 11, a nozzle 64 according to the invention may include a single secondary passage 78 formed in the nozzle wall 92. The nozzle body 82 may also include features for securing or attaching to a rotary drill bit 40. For example, the outer side surface 88 of the nozzle body 82 may include threads 98 for engaging a complimentarily shaped threaded surface (not shown) that is formed within a nozzle port of a drill bit. Further, nozzle body 82 may include an annular channel (not shown) in a periphery thereof that is adapted for receiving a sealing element such as, for example, an O-ring for sealing between a nozzle port (e.g., nozzle port 68 as shown in FIGS. 2A-2C) formed in a rotary drill bit 40 (FIG. 2A) and the nozzle body 82. The nozzle 64 may also include features on the exit end surface 84 that may engage with tools used to install, adjust and/or orient the nozzle 64.

Figure 12:
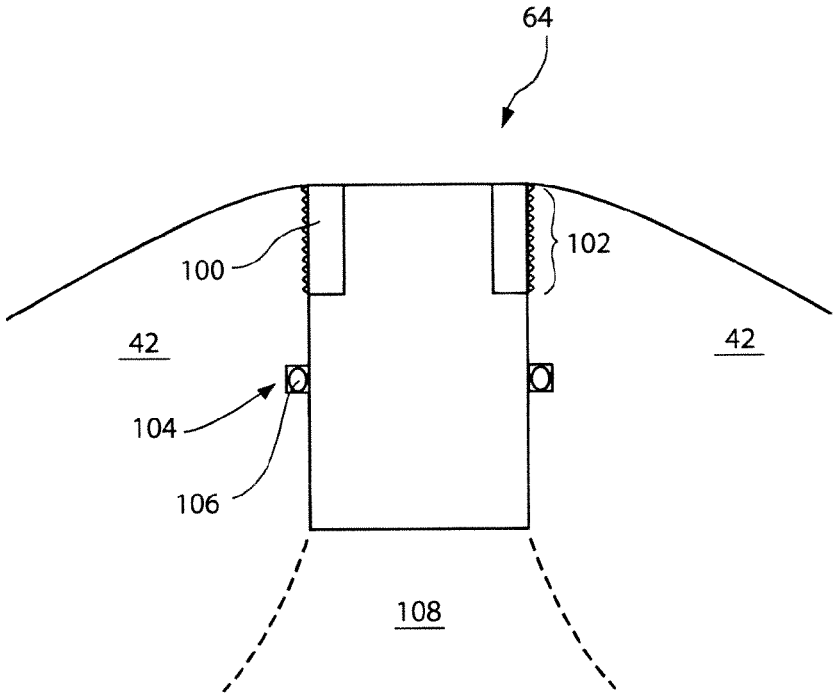
FIGS. 12 and 13 show partial cross-sectional views of nozzles installed into drill bit bodies according to embodiments of the invention.
Figure 13:
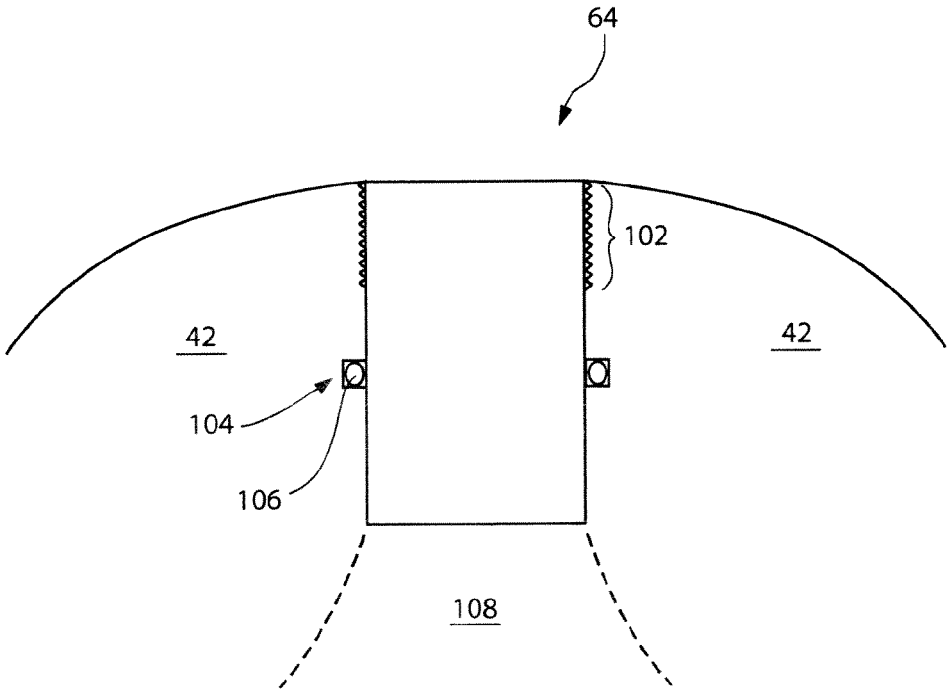

In further detail, FIGS. 12 and 13, show two embodiments for attaching the nozzle 64 to a drill bit body 42. Particularly, FIG. 12 shows a partial cross-sectional view of a nozzle 64 installed within a bit body 42, wherein a retaining ring 100 is attached to the bit body 42 along an attachment region 102. The retaining ring 100 may be attached to the bit body 42 by way of a threaded surface, brazing, welding, pins, or as generally known by persons having ordinary skill in the art. Similarly, FIG. 13 shows a partial cross-sectional view of a nozzle 64 installed within a bit body 42, wherein the nozzle 64 is one piece and includes an attachment region 102 for attachment to the bit body 42. As shown in FIGS. 12 and 13, a cavity 104 may be optionally formed in the bit body 42 for accepting a sealing element 106, such as an O-ring, for example, for providing sealing between the bit body 42 and the nozzle 64. Also, as described above, a conduit or plenum 108 is formed in the bit body 42 and configured for conducting drilling fluid to the nozzle 64. It is recognized, that while the nozzle 64 is shown attached within the drill bit body 42 being flush with the surface thereof, the nozzle 64 may slightly extend above the surface of the drill bit body 42 or, more practically, be recessed to a certain extent below the surface of the drill bit body 42.

It may be further appreciated, that the orientation of a nozzle 64 according to the invention may be selectively adjusted since the spray patterns 72 and 76 (FIG. 5) may be directed desirably according to the orientation of the nozzle 64. Therefore, the invention contemplates that the nozzle 64 may be configured for attachment to a rotary drill bit 40 (FIG. 2A) at a selected orientation. In an embodiment wherein the nozzle 64 includes a threaded surface 98 for attachment to a drill bit body 42, as shown in FIGS. 10 and 11, accuracies of at least about ±2° may be achieved. Further, at least one mark or indicium 110 formed or placed on the nozzle 64 may be used to visually indicate a rotational orientation of the nozzle 64. Such a configuration may allow for selective orientation of a flow through a nozzle 64 of the invention, which may be desirable when a nozzle 64 of the invention is installed within a rotary drill bit 40.

Thus, the invention contemplates that the direction, size, and configuration of the secondary spray patterns 76 exiting a nozzle 64 of the invention may be preferentially tailored for delivering drilling fluid for cleaning, cooling, or both cleaning and cooling cutting elements 52 (FIG. 2A) upon a rotary drill bit 40 (FIG. 2A).

In embodiments of the invention, the nozzle body 82, the primary passage 74 and secondary passage 78 (FIGS. 10 and 11) may include various sizes and cross-sectional shapes; and various alternative structures may be employed for attaching the nozzle 64 to a rotary drill bit 40.

In still other embodiments of the invention, the primary passage 74 and/or the secondary passages 78 may be configured as channels, conduits, feeds, slits, ports, and passageways for example, and without limitation.

Generally, drill bits in accordance with embodiments of the invention, may have one or more nozzles each having a primary orifice that will comprise the largest percentage of total flow area. Extending adjacent to, or substantially surrounding the main orifice, there may be placed within the nozzle one or more secondary orifices or "slits" (such term not being restrictive of the shape of such secondary orifices) that allow drilling fluid to be dispersed from an exit surface of the nozzle at a greater radial distance from the primary orifice and will comprise a smaller total flow area relative to the flow area of the primary orifice. The one or more "slits" may be aimed at an angle away from the main orifice to spread drilling fluid away from the spray pattern of the primary orifice in order to increase the hydraulic footprint of the nozzle.

While certain representative embodiments and details have been shown for purposes of illustrating the invention, it will be apparent to those skilled in the art that various changes in the methods and apparatus disclosed herein may be made without departing from the scope of the invention, which is defined in the appended claims and their legal equivalents.

What is claimed is:

1. A drilling assembly for drilling subterranean formations, the drilling assembly comprising:

a drill body having at least one nozzle port and an inner plenum in fluid communication with the at least one nozzle port; and a nozzle coupled to the at least one nozzle port of the drill body in fluid communication with the inner plenum, the nozzle comprising:

a substantially cylindrical nozzle body having an axis, an inlet port and an exit end surface, the exit end surface being substantially planar;

a primary passage extending through the substantially cylindrical nozzle body from the inlet port to the exit end surface and substantially aligned with the axis; and at least one arcuate slit-shaped secondary passage extending at least partially through the substantially cylindrical nozzle body to substantially the same planar exit end surface of the substantially cylindrical nozzle body and diverging from the primary passage, the at least one arcuate slit-shaped secondary passage having a cross-sectional area shaped generally as a segment of an annulus symmetrically radially distributed about the primary passage in the exit end surface of the substantially cylindrical nozzle body.

2. The drilling assembly of claim 1, wherein the at least one arcuate slit-shaped secondary passage extends from the primary passage, below a restriction of the primary passage, to the exit end surface of the nozzle.

3. The drilling assembly of claim 1, wherein the substantially cylindrical nozzle body comprises an outer side surface receivable into a drill bit nozzle port for engagement therewith, and an inlet end surface comprising the inlet port.

4. The drilling assembly of claim 3, wherein the at least one arcuate slit-shaped secondary passage extends from the inlet end surface to the exit end surface.

5. The drilling assembly of claim 1, wherein the at least one arcuate slit-shaped secondary passage extends from the primary passage to the exit end surface.

6. The drilling assembly of claim 1, wherein the at least one arcuate slit-shaped secondary passage comprises at least two arcuate slit-shaped secondary passages.

7. The drilling assembly of claim 1, wherein the primary passage comprises a substantially larger hydraulic cross section than the at least one arcuate slit-shaped secondary passage.

8. The drilling assembly of claim 1, wherein one of the at least one arcuate slit-shaped secondary passage is in fluid communication with the primary passage.

9. The drilling assembly of claim 1, wherein the at least one arcuate slit-shaped secondary passage extends through the substantially cylindrical nozzle body from an inner surface of the primary passage to the exit end surface of the substantially cylindrical nozzle body.

10. The drilling assembly of claim 1, wherein the drill body is a body of a drag-type rotary drill bit or a roller cone drill bit.

11. A nozzle for a drilling tool for drilling subterranean formations, the nozzle comprising:

a substantially cylindrical nozzle body having an axis, an inlet port and an exit end surface, the exit end surface being substantially planar;

a primary passage extending through the substantially cylindrical nozzle body from the inlet port to the exit end surface and substantially aligned with the axis; and at least one arcuate slit-shaped secondary passage extending at least partially through the substantially cylindrical nozzle body to substantially the same planar exit end surface of the substantially cylindrical nozzle body and diverging from the primary passage, the at least one arcuate slit-shaped secondary passage having a cross-sectional area shaped generally as a segment of an annulus symmetrically radially distributed about the primary passage in the exit end surface of the substantially cylindrical nozzle body.

12. The nozzle of claim 11, wherein the at least one arcuate slit-shaped secondary passage diverges from the primary passage directly or substantially adjacent the exit end surface of the nozzle.

13. The nozzle of claim 11, wherein the substantially cylindrical nozzle body comprises an outer side surface engageably receivable into a drill bit, and an inlet end surface comprising the inlet port.

14. The nozzle of claim 13, wherein the at least one arcuate slit-shaped secondary passage extends from the inlet end surface to the exit end surface.

15. The nozzle of claim 11, wherein the at least one arcuate slit-shaped secondary passage extends from the primary passage to the exit end surface.

16. The nozzle of claim 11, wherein the at least one arcuate slit-shaped secondary passage comprises at least two arcuate slit-shaped secondary passages.

17. The nozzle of claim 11, wherein the primary passage comprises a substantially larger hydraulic cross section than the at least one arcuate slit-shaped secondary passage.

18. The nozzle of claim 11, wherein one of the at least one arcuate slit-shaped secondary passage is in fluid communication with the primary passage.

19. The nozzle of claim 11, wherein the at least one arcuate slit-shaped secondary passage extends through the substantially cylindrical nozzle body from an inner surface of the primary passage.

20. A method of conveying drilling fluid through a nozzle for use on a rotary drilling assembly for forming a subterranean borehole, the method comprising:

introducing a drilling fluid into an inlet end of a nozzle;

directing a majority of the drilling fluid received by the inlet end of the nozzle through a primary passage to a substantially planar exit end surface of the nozzle to form a main cone spray pattern;

directing another portion of the drilling fluid through at least one arcuate slit-shaped secondary passage to substantially the same planar exit end surface of the nozzle to form a secondary spray pattern having a cross-sectional area shaped generally as a segment of an annulus;

diverging the drilling fluid through the at least one arcuate slit-shaped secondary passage from the drilling fluid directed through the primary passage; and distributing the diverted drilling fluid symmetrically radially about the primary passage.

21. The method of claim 20, further comprising directing the drilling fluid through the at least one arcuate slit-shaped secondary passage to fan divergently from the drilling fluid exiting the primary passage.

* * * * *